US005775372A

United States Patent [19]

Houlihan

[11] Patent Number: 5,775,372

[45] Date of Patent: Jul. 7, 1998

[54] UNIVERSAL WATER AND ENERGY CONSERVATION SYSTEM

[76] Inventor: John A. Houlihan, 1210-A E. Foster Rd., Santa Maria, Calif. 93455

[21] Appl. No.: 675,967

[22] Filed: Jul. 5, 1996

[51] Int. Cl.[6] ..... F16K 49/00

[52] U.S. Cl. ..... 137/624.12; 137/337; 137/565; 417/32

[58] Field of Search ..... 137/624.12, 337, 137/389, 390, 563, 565; 417/12, 32

[56] References Cited

U.S. PATENT DOCUMENTS 5,261,443 11/1993 Walsh ..... 137/337
5,564,462 10/1996 Storch ..... 137/337

*Primary Examiner*—Kevin Lee

[57] ABSTRACT

An on demand, multi-faceted, programmable, electronically and electromechanically controlled, water and energy conservation system, easily segmented and adaptable to the limitations of varying structures, specific conservation goals and each user's economic considerations. The energy saver segment and one of several water saver segments may be combined into a complete system, configurational to differing conditions and useable with any pressurized water supply. The invention may also be configured for installation in existing, new or add-on structures. Preselected opening and closing of remotely actuated valves alters conduit paths, to avoid water waste down the drain, waiting for hot water. Hot water delivered from the hot water supply is completely used, eliminating the energy waste of hot water cooling in the pipes. On command from radio control unit (11) or remote control unit (9), power control (21) energizes flow controller (22) pre-programed to selectively energize and de-energize remotely actuated valve (61) or (62), and pump (66) of flow control unit (10), to simultaneously deliver hot water and re-circulate standing water in applicable conduits (32), (40), and (42), or (52), to hot water supply (31). Automatically, or by the user's override command, near the end of the selected use cycle, another conduit path is provided. Cold water supply pressure (12) to hot water supply (31) is interrupted through normally open, remotely actuated valve (94) and is re-directed through normally closed, remotely actuated valve (93), forcing delivered hot water to the open outlet, until used. The system operates only when commanded.

14 Claims, 2 Drawing Sheets

UNIVERSAL WATER AND ENERGY CONSERVATION SYSTEM

BACKGROUND

1. Field of the Invention

This invention relates to a hot and cool water delivery system, more particularly to a water saving, energy conserving system that is sufficiently flexible in design, to be conveniently installed in a variety of residential or commercial structures, be they new construction, add-on construction, or presently existing buildings.

2. Description of the Problem Area

In a conventional plumbing system, which includes a water heating tank, it is a well known fact that, after every use hot water is retained in the line between the hot water supply and the outlet and it cools. Later this cooled water is wasted down the drain, waiting for hot water to arrive at the outlet; water and the energy to heat that water are wasted. In order to solve the singular problem of water waste, hot water recirculating systems are suggested, but unfortunately, no energy is saved.

Hot water recirculation systems require additional piping to complete a loop from the furthest hot water outlet, returning to the hot water supply. In structures where hot water use areas are located in different directions from the hot water supply location, return loops from each use area are required. Return pipe loops contribute to the loss of additional heat, because of the increased volume of water cooling and the increased cooling surface of the added lengths of pipe; even insulated pipes relinquish their heat. Sensors react to water cooling in the lines, triggering frequent pump operation. Public Utilities rate recirculating pump systems as net energy consumers and during the cooler months of the year, energy consumption and costs can rise appreciably.

In existing structures, installing unexposed replumbing lines becomes prohibitively expensive and messy and for most home owners, requires the hiring of one or more building trades professionals and the filing of an application for a building permit. The cost and time delays involved in the approval by the permitting agency adds to the expense and inconvenience.

When closely considered, the type of recirculating system designed to insure instant hot water at any point along a hot water service conduit conserves water, but it is not energy efficient. Regularly re-circulating cooling water back to the water heating unit results in a wasteful condition. The water transported between the furthest use point and the water heating unit, although lower in temperature than that of the hot water being delivered still contains a considerable amount of heat. Thus, the amount of heated water subjected to cooling in the line is approximately double that of the same structure without recirculation. The price paid for the conservation of water would be prohibitively high, especially for the 33.5 million households that the U.S. Census Bureau reports utilize electric water heating.

The advantages of any system that conserves water or energy seem obvious. Yet because of economic reasons and because of the many and varied differences between structures, any singularly designed system will have only limited application. Available space, the location, and size of available space, along with the location of hot water use areas and the proximity of the water heating unit to these use areas are all determining factors. Differing climatic conditions, especially extreme cool, can also influence a system's configuration, as does the status of the structure; be it under construction, add-on construction or an existing building. The need for an easily adaptable system, capable of being configured to meet one, more or all of the variable influencing limitations, indicates that a flexible, multi-faceted system, capable of saving water, energy or both and having the broadest application potential, would be the most complete solution.

BRIEF DESCRIPTION OF PRIOR ART

Vataru, et al U.S. Pat. No. 4,160,461 Jul. 10, 1979

Vataru shows a water saving system. This system fails to address the problem of lost energy due to hot water cooling in the plumbing lines between hot water usage cycles. He does not address the energy loss problem of hot water left to cool in the lines. No indication is given that the system has the built in design or flexibility to accept the addition of any type of compatible unit, sub-assembly or segment, which would expand the system to include an energy saving capability.

Lujan U.S. Pat. No. 4,606,325 Aug. 19, 1986

Lujan, shows a hot water recirculation system. In existing structures this system requires the installation of a return line to recirculate cooled hot water to the water heater. He does not address the energy loss problem of hot water left to cool in the lines. No indication is given that the system has the built in design or flexibility to accept the addition of any type of compatible unit, sub-assembly or segment, which would expand the system to include an energy saving capability.

Powers & Powers U.S. Pat. No. 4,697,614 Oct. 6, 1987

Powers shows a water conservation system. This system requires an installation below each sink taking up most of the storage space beneath the sink. It does not address the problem of energy loss due to hot water cooling in the lines. No indication is given that the system has the built in design or flexibility to accept the addition of any type of compatible unit, sub-assembly or segment, which would expand the system to include an energy saving capability.

Frazekas U.S. Pat. No. 4,750,472, Jun. 14, 1988

Frazekas shows a hot water recirculation system. He does not address the energy loss problem of hot water left to cool in the lines. No indication is given that the system has the built in design or flexibility to accept the addition of any type of compatible unit, sub-assembly or segment, which would expand the system to include an energy saving capability.

Barrett, et al U.S. Pat. No. 4,870,986 Oct. 3, 1989

Barrett shows a system for dispensing liquid at a desired temperature. This system is primarily one for moderating temperature and controlling flow at system outlets. In existing structures this system requires the installation of a return line to recirculate cooled hot water to the water. He does not address the energy loss problem of hot water left to cool in the lines. No indication is given that the system has the built in design or flexibility to accept the addition of any type of compatible unit, sub-assembly or segment, which would expand the system to include an energy saving capability.

Laing, et al U.S. Pat. No. 4,917,142 Apr. 17, 1990

Laing shows a hot water recirculation system. In existing structures this system requires the retrofitting of the existing plumbing system with additional piping to form a hot water return loop to the hot water reservoir. He does not address the energy loss problem of hot water left to cool in the lines. No indication is given that the system has the built in design or flexibility to accept the addition of any type of compatible unit, sub-assembly or segment, which would expand the system to include an energy saving capability.

Haws—U.S. Pat. No. 4,930,551 Jun. 5, 1990

Haws shows a hot water recovery system with a water heater apparatus having a closed cylindrical cylinder within the heater tank.

This system cannot be utilized effectively with a conventional water heater. He does not address the energy loss problem of hot water left to cool in the lines. No indication is given that the system has the built in design or flexibility to accept the addition of any type of compatible unit, sub-assembly or segment, which would expand the system to include an energy saving capability.

Peterson U.S. Pat. No. 4,930,551 Jun. 26, 1990

Peterson shows a system for controlling the recirculation of a hot water distribution system. In existing structures this system requires the installation of a return line to recirculate cooled hot water to the water heater. He does not address the energy loss problem of hot water left to cool in the lines. No indication is given that the system has the built in design or flexibility to accept the addition of any type of compatible unit, sub-assembly or segment, which would expand the system to include an energy saving capability.

Imhoff U.S. Pat. No. 5,009,572 Apr. 23, 1991

Imhoff shows a water conservation system installed inside a standard bathroom vanity. This system requires a pump unit at the hot water outlets and the need for an electrical outlet at each use point. He does not address the energy loss problem of hot water left to cool in the lines. No indication is given that the system has the built in design or flexibility to accept the addition of any type of compatible unit, sub-assembly or segment, which would expand the system to include an energy saving capability.

Lund U.S. Pat. No. 5,042,524 Aug. 27, 1991

Lund shows a demand recovery hot water system. This system does not address the problem of lost energy due to hot water cooling in the plumbing lines, between hot water usage cycles.

In existing structures this system requires the retrofitting of the existing plumbing system with additional piping to form a hot water return loop to the hot water reservoir. No indication is given that the system has the built in design or flexibility to accept the addition of any type of compatible unit, sub-assembly or segment, which would expand the system to include an energy saving capability.

Hass U.S. Pat. No. 5,050,062, September 1991

Hass shows a water conservation system. He does not address the energy loss problem of hot water left to cool in the lines. No indication is given that the system has the built in design or flexibility to accept the addition of any type of compatible unit, sub-assembly or segment, which would expand the system to include an energy saving capability.

Britt U.S. Pat. No. 5,105,846 Apr. 21, 1992

Britt shows a water saving system. This system is designed to prevent water waste but it does not address the problem of lost energy due to hot water cooling in the plumbing lines, between hot water usage cycles. No indication is given that the system has the built in design or flexibility to accept the addition of any type of compatible unit, sub-assembly or segment, which would expand the system to include an energy saving capability.

Massaro, et al U.S. Pat. No. 5,205,318, Apr. 27, 1993

Massaro shows a water saving system. This system requires installation of a manifold unit beneath the sink, taking up a large amount of space. Once usage is completed the problem still exists of heated water cooling in the lines. No indication is given that the system has the built in design or flexibility to accept the addition of any type of compatible unit, sub-assembly or segment, which would expand the system to include an energy saving capability.

Walsh—U.S. Pat. No. 5,261,443—Nov. 16, 1993

Walsh shows a water saving recirculating system which, in an existing structure would require additional electrical wiring between the pump, the electronic control, the switches, the thermal switches and the solenoid valves; an expensive alteration which in most jurisdictions is a task that must be performed by a licensed electrician and requires a building permit. He does not address the energy loss problem of hot water left to cool in the lines. No indication is given that the system has the built in design or flexibility to accept the addition of any type of compatible unit, sub-assembly or segment, which would expand the system to include an energy saving capability.

Houlihan, U.S. Pat. No. 5,351,712, Oct. 4, 1994

Houlihan shows a hot water recovery system, requiring vent-relief devices at each use point and is not easily adaptable to varying conditions or user's conservation goals.

Lund U.S. Pat. No. 5,385,168, Feb. 14, 1995

Lund shows a temperature controlled water saving, hot water recirculation system. He does not address the energy loss problem of hot water left to cool in the lines. No indication is given that the system has the built in design or flexibility to accept the addition of any type of compatible unit, sub-assembly or segment, which would expand the system to include an energy saving capability.

Bowman U.S. Pat. No. 5,452,740, Sep. 26, 1995

Continuation in part of U.S. Pat. No. 5,339,859. Bowman shows a water conservation system. He does not address the energy loss problem of hot water left to cool in the lines. No indication is given that the system has the built in design or flexibility to accept the addition of any type of compatible unit, sub-assembly or segment, which would expand the system to include an energy saving capability.

Price U.S. Pat. No. 5,511,579, April 1996

Price shows a thermal sensitive recirculation water conservation system. He does not address the energy loss problem of hot water left to cool in the lines. No indication is given that the system has the built in design or flexibility to accept the addition of any type of compatible unit, sub-assembly or segment, which would expand the system to include an energy saving capability.

Storch—U.S. Pat. No. 5,564,462—Oct. 15, 1996

Storch shows a water saving delivery system. In an existing structure, it requires wiring to be run from the shower stalls back to the pump, in the area of the water heater and routing and attaching new pipes within the structure walls. This retrofitting becomes an expensive alteration which, in most jurisdictions, are tasks that must be performed by a licensed electrician and plumber and require a building permit. He does not address the energy loss problem of hot water left to cool in the lines. No indication is given that the system has the built in design or flexibility to accept the addition of any type of compatible unit, sub-assembly or segment, which would expand the system to include an energy saving capability.

OBJECTS AND ADVANTAGES

Accordingly, one object of the invention is to provide an improved, water and energy saving hot water system, adaptable to the varying limitations of a wide range of structures.

Another object of the invention is to provide an improved, water and energy saving hot water system, adaptable to the conservation goals and economic considerations of the user.

Another object is to provide a system which delivers hot water on demand without having to waste water down the drain, waiting for hot water to arrive at the hot water outlet.

Another object is to provide a system that utilizes all the delivered hot water from the hot water supply, eliminating the heat loss of water left cooling in the plumbing lines, after each use.

Another object is to provide a water saving system that can be used with any type of water heating apparatus, including solar.

Another object is to provide an energy saving system that can be used with any type of water heating apparatus, including solar.

Another object of the invention is to provide an energy and water savings system that may be configured for and installed in a new construction structure with a minimum and inexpensive alteration to a standard plumbing plan.

Another object is to provide a system for existing structures which utilizes only the original plumbing lines, eliminating the need for expensive retrofitting of the plumbing system of an existing structure.

Another object is to provide a water and energy saving system that can be installed and operated in an existing structure without alteration of or addition to the electrical wiring.

Another object of the invention is to provide an energy saving segment and/or water saving segment that may be configured for and installed in an add on structure to an existing structure, which already has an operational system installed.

Another advantage is that where budgets are limited or energy saving is the only intended conservation goal, an alternative to installing a complete system is that the energy saver segment of the system can be installed to operate independently, at a lower cost to the consumer.

Another advantage is that where budgets are limited or only water saving is the intended conservation goal, an alternative to installing a complete system is that one of the water saver segments can be installed to operate independently, at a lower cost to the consumer.

Another advantage of the system is that at some later point in time, for economic reasons or because of a desire to extend the conservation capability of the system, one segment can be easily and conveniently added to the opposite, previously installed segment, to form a complete system.

Another advantage of the system's adaptability and flexibility is that a complete system can be installed in one of several segmented configurations, where space is limited, the layout of the structure dictates, and/or as consumers' preferences vary.

Another advantage is that the system may be configured as a must-operate device, which will shut off delivery of hot water to a specific use point after a fixed period of time, to avoid wasteful, unnecessary running of hot water, e.g. military barracks, college dormitories, etc.

Another advantage is that the user can shorten the use-time of any programmed cycle when a shortened use period is desired, by means of an over-ride command capability.

Another advantage is that the user can lengthen the use-time of any programmed cycle when a lengthened use period is desired, by means of an over-ride command capability.

Another advantage is that an agreed upon use-time can be programmed into the controller adjusted for an agreed amount of time for each specific use point, avoiding the added water and energy waste, of too long showers; voluntarily limiting the total time of the hot water use cycle, contributes to additional water and energy savings.

Another advantage of the system is that the heating load of the hot water supply is reduced increasing its service life.

Another advantage is that the complete system is light weight and is easily transportable.

Another advantage is that property lessees could install a system in a rented property and be able to easily disconnect the system for equally easy re-installation at a new location, allowing lessees to benefit from water and energy bill savings, in a property owned by others.

Another object is, where applicable, to provide a basic, single mode water saver segment that can be expanded to a three-mode advanced water saver segment, when there is adequate space in which to locate a holding tank.

Another advantage is that the practice of sacrificing interior space of a dwelling to locate a hot water supply, in order to shorten hot water service lines can be changed. In the system no hot water is left to cool in the lines so the hot water supply could be located in the basement, garage, or in an outside enclosure (in warm climates); increasing interior living space, without increasing water heating costs.

Another advantage is that only basic hand tools are required and the average homeowner could install a system in a few hours.

These and other objects and advantages of the present invention will become apparent from a consideration of the following detailed description and the accompanying drawings.

SUMMARY

According to the present invention there is provided a water and energy conservation system which solves the problem of water waste and energy loss, in a manner unknown heretofore.

The universal water and energy conservation system is a multi-faceted, programmable, electronically and electromechanically controlled water and energy conservation system. The system is easily segmented and adaptable to the limitations of varying structures, and each user's economic and conservation goals. The energy saver segment and one of several water saver segments are combined into an effective system, suited to different conditions and useable with any pressurized water supply. The invention may be configured for installation in existing, new construction or add-on structures.

The herein described universal water and energy conservation system satisfies the key element of universality of design and flexibility in application. Each configuration is designed to accomplish energy and/or water saving tasks within certain physical limitations of the structures into which they are installed and to meet the priorities and preferences of the end user.

When the installation of a complete system is not immediately possible, the user may start with either an energy saver segment or one of the water saver segments as a cornerstone. One segment or the other may be initially configured to operate independently, to fulfill at least one conservation goal, under virtually any set of conditions. Later as economic conditions permit or as added conservation is desired the un-installed segment can be conveniently added, to complete the system. The wide range of adaptable configurations would enable property lessees, as well as property owners, to benefit from the advantages of water and energy conservation. The system is light weight, transportable and is not difficult to install or move to another location.

The universal water and energy conservation system offers an on demand, broadly adaptable solution to the problem of the unnecessary, large scale waste of energy and potable water. The system is in operation only when hot water is needed. It eliminates energy loss of water cooling in the lines and stops completely the waste of potable water down the drain, while waiting for hot water to arrive at the outlet.

DESCRIPTION OF PREFERRED EMBODIMENTS

The universal water & energy conservation system is configured as a single unit, which may be wall mounted or free standing. Its most energy efficient location would be in close proximity to the structure's hot water supply. However, it can be located at a more convenient space in the structure without altering its operation or manufacture.

Figure 1:
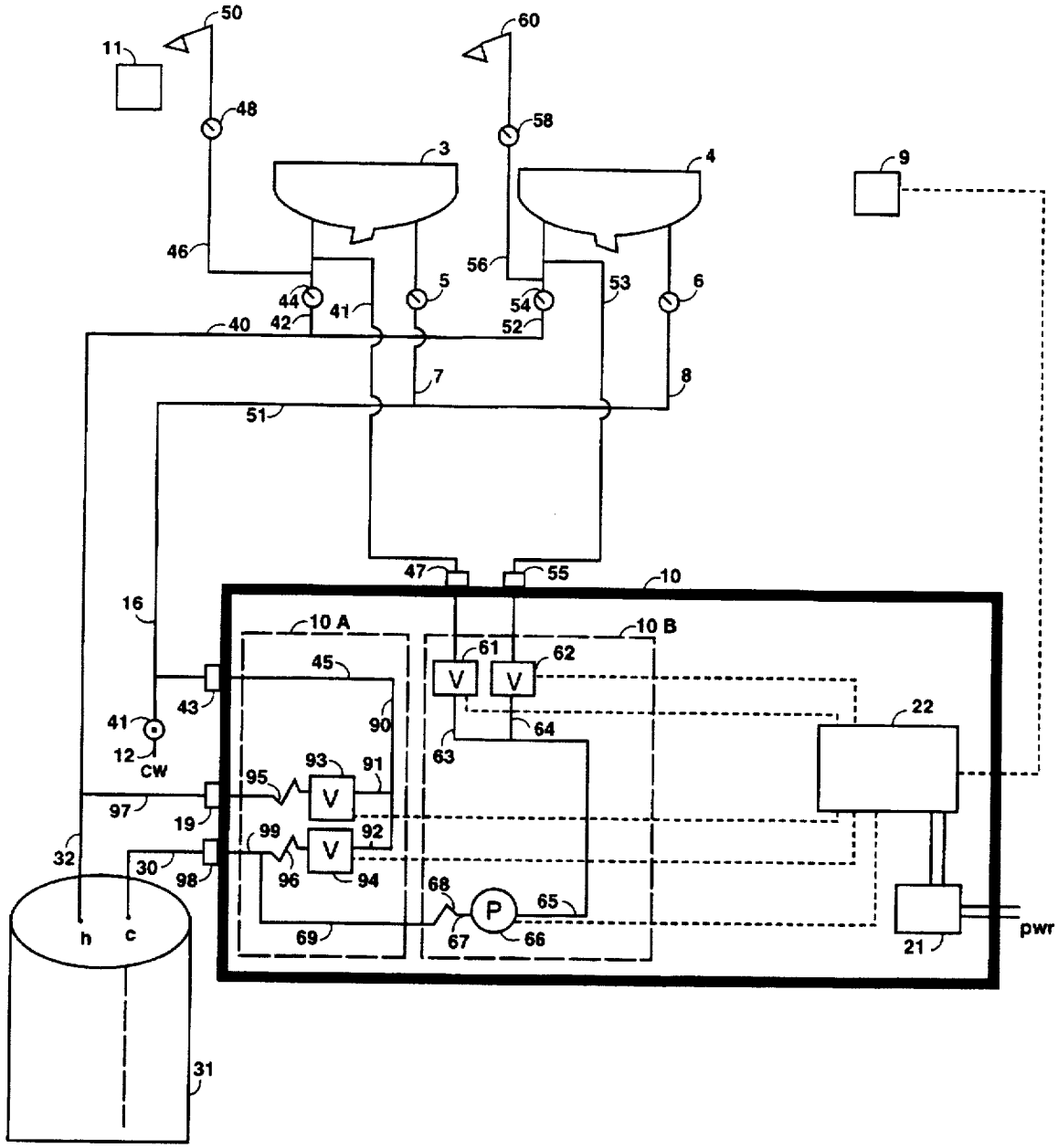
FIG. 1 is a flow diagram for a water distribution system primarily, for a new construction building, embodying the present invention.

As shown in FIG. 1, the described embodiment, is most suitable to be incorporated into new construction. The system may be remotely activated by signal generating devices electrically wired into the structure, by any one of several types of radio control apparatus, by an AC line modulated signal device and by a combination of these control devices.

The water saver segment of the system is designed to service each area in the structure, where a hot water outlet is to be used, utilizing separate branched hot water service conduits to each service area, each in fluid communication with separate return conduits. The flow path of each return conduit is opened or closed, by a remotely actuated valve. This permits the cool water standing in the hot water distribution conduits, which would normally be permitted to be wasted down the drain waiting for hot water to arrive at a use point, to be re-directed back through return conduits to the flow control unit and then to the hot water supply.

The energy saver segment of the system is designed so that in the final stage of the hot water use cycle the system's flow control unit may be actuated by either a remote control signal transmitted by the hot water user or by a programmed time delay signal. The energy saver segment has its valves configured so that the cool water supply is re-directed to the hot water supply line, while cool water supply pressure to the hot water supply is temporarily interrupted. This pressurized cool water forces hot water, in the hot water distribution conduits, between the hot water supply and the use point, towards the open hot water outlet. In this mode all the hot water having been delivered from the hot water supply is consumed and fresh cool water remains in the hot water distribution conduit. This eliminates the energy loss from hot water, which in a standard plumbing system would be trapped between the outlet and the hot water supply and left to cool in the line.

Turning now to FIG. 1

In the static condition flow control components of water saver segment 10B and energy saver segment 10A are in the de-energized state. Flow control unit 10 is in the ready state, capable of receiving and acting upon electronically transmitted commands. Power control 21 directs power to selected circuits of flow controller 22. Flow controller 22 directs power to specific components of water saver segment 10B and energy saver segment 10A. In the static state the pressurized cool water supply line 12 furnishes the cool water supply through manual shut off valve 14, through main cool water supply conduit 16 to inlet 43 of flow control unit 10. The flow path continues via conduits 45, 90 and 92, to the inlet side of normally open-to-flow, remotely actuated valve 94. The output side of valve 94 is in fluid communication with the inlet side of hot water supply 31, via check valve 96, and conduit 99 to flow control unit outlet 98 and cool water inlet conduit 30. This causes hot water supply 31 to be subject to system supply pressure. Cool water supply to the structure's cool water service conduits is via main cool water supply conduit 16, continuing through conduit 51. The flow is branched from conduit 51 at service conduit 7 to service area A and at service conduit 8, to service area B. Any additional cool water service areas would be branched from conduit 51.

The hot water output of hot water supply 31 furnishes hot water, under system pressure to the structure. Hot water flow is via hot water supply outlet conduit 32 and conduit 40. Each service conduit to separate use points in the structure is branched off from conduit 40. Service conduit 42 branches off to service area A, furnishing hot water to sink 3 through shut-off valve 44 and to shower/bath unit 50, via conduit 46, and manual control valve 48. Service conduit 52 branches from conduit 40 to furnish hot water to sink 4 via shut-off valve 54 and to shower/bath outlet 60 via conduit 56 and manual control valve 58. Opening any outlet will permit the use of pressurized hot water. Any additional hot water service to other areas would be branched from conduit 40.

Return conduit 41 from service area A is in fluid communication with hot water service conduit 40 and flow control unit inlet 47 and water saver segment 10B and thence to the inlet side of normally closed-to-flow, remotely actuated valve 61. The outlet of valve 61 is in fluid communication through conduits 63 and 65, with the inlet of pump 66, de-energized in the static state.

Return conduit 53 from service area B is in fluid communication with hot water service conduit 52, flow control unit inlet 55 and water saver segment 10B and thence to the inlet side of normally closed-to-flow, remotely actuated valve 62. The outlet side of valve 62 is in fluid communication through conduits 64 and 65, with the inlet side of pump 66, de-energized in the static state.

The output side of pump 66 is coupled to check valve 68 thru conduit 67; conduit 69 completes a flow path to a tee-fitting in conduit 99, and thence through flow control unit outlet 98 and cool water inlet conduit 30 to hot water supply 31.

Remote control unit 11 is moisture proof radio signal remote in radio communication with flow control unit 10.

Remote control unit 9 is in electrical continuity with flow control unit 10.

Manual shutoff valve 5 controls cool water to area A and manual shutoff valve 4 controls cool water to area B.

Operation FIG. 1:

Conserving Water: When hot water is desired, remote control unit 9 is activated to select the use point to which the hot water is to be furnished. Power control 21 furnishes the power to flow controller 22, which activates water saver segment 10B. Assuming service area A as the selected use point the following timed sequence of water saver segment 10B occurs. Normally closed-to-flow, remotely activated valve 61 is energized to the open to flow position and pump 66 is activated. For a pre-selected period of time, dictated by the distance from hot water supply 31 to service area A, pump 66 will circulate hot water from hot water supply 31 to the use point, as it draws the standing cool water back to hot water supply 31, along a continuous conduit path as follows: Using conduit 41 as a starting point in a closed loop, cool water standing in conduit 41 is drawn by pump 66, through inlet 47 of the flow control unit 10, to the input side of the open-to-flow, remotely actuated valve 61. Flow from the output side of valve 61 is through conduits 63 and 65 to the input of pump 66. Flow from the output side of energized pump 66 is via conduit 67, check valve 68 conduits 69 and 99, to the outlet 98 of flow control unit 10. Flow, under pump pressure continues via cool water inlet conduit 30 to hot water supply 31. Pump pressure forces hot water to be transported out of hot water supply 31, via the hot water outlet conduit 32. The flow is then through conduit 40 and hot water service conduit 42 through manual shut off valve 44 to the junction with return conduit 41. This completes a closed loop conduit path between the hot water supply 31 and service area A. At the preprogramed time, at which hot water arrives at service area A, the flow controller 22 causes pump 66 to de-energize, and remotely actuated valve 61 to de-energize to the normally closed-to-flow position.

Normal Use Cycle

Hot water is now available for immediate use. The use time period can be controlled by the user, or automatically controlled by a programmable, time-certain period, programmed into the flow controller 22.

When use time control by the user is desired, then radio control unit 11 is employed as an over-ride control, at the use point. Whether preprogrammed or controlled by the user, the operational function is the same. The adjustable preprogrammed signal or a signal from radio control unit 11, at some point in the latter stage of the use cycle, causes the following events to occur:

Energy Conservation Cycle

The energy saver segment 10A is activated by flow controller 22 and the following events occur. Normally open-to-flow remotely actuated valve 94 is energized to the close-to-flow position and normally closed-to-flow, remotely actuated valve 93 is energized to the open-to-flow position. This event causes cool water supply pressure to be interrupted to water supply 31. Cool water supply pressure, through the open-to-flow condition of valve 93 is now in fluid communication with hot water supply outlet conduit 32. Pressurized cool water flow is through conduit 91 and now open-to-flow remotely actuated valve 93, through check valve 95 flow control unit outlet 19 and conduit 97. Cool water supply pressure forces hot water in conduits 40 and 42, to flow towards the open hot water outlet.

Depending upon the distance to the use point, the hot water user has a specified time to complete the use cycle. As the user senses the water cooling, the outlet is closed. Shortly thereafter energy saver segment 10A valves are automatically de-energized to their static condition.

Hot water normally left standing in the lines to cool, now has been fully utilized and replaced by cool water, so that no energy is wasted, due to hot water cooling in the line. Where desirable, an adjustable audible warning device may be employed to signal the user, that the hot water cycle will be shortly completed and the hot water will be completely used up in a specified amount of time.

Service area B functions identical to service area A, except the hot water service conduit is conduit 52 and the return conduit is 51. The return flow path is completed to hot water supply 31 through flow control unit inlet 55 and remotely actuated valve 62 in fluid communication with pump 66. The flow follows the same, single conduit path out of the flow control unit 10 at outlet 98 to cool water inlet conduit 30 of hot water supply 31. The adjustable time of the cycle is determined by the distance from hot water supply 31 to service area B. Check valves 95, 96, 68 are to limit back flow, protecting system components. Remote control 9 is hard wired at one or more locations in the structure.

Figure 2:
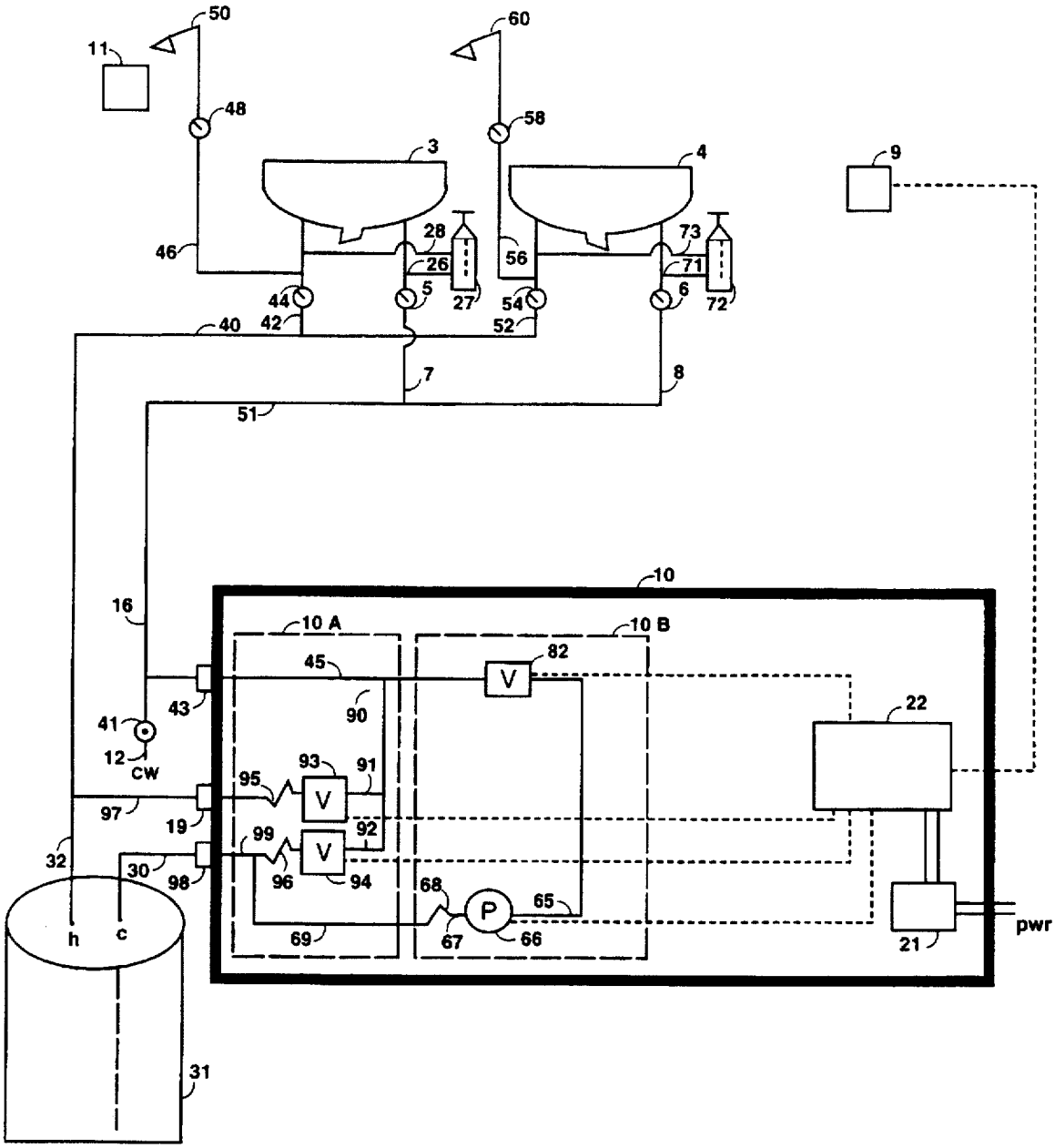
FIG. 2 is a flow diagram for a hot water distribution system, primarily for an existing building, embodying an alternate embodiment of the present invention.

Turning now to FIG. 2

There is shown an alternative embodiment of the present invention, primarily configured for installation in an existing structure. The flow control components of water saver segment 10A and energy saver segment 10B are in the de-energized state. Flow control unit 10 is in the ready state, capable of receiving and acting upon electronically transmitted commands. Power control 21 directs power to selected circuits of the flow controller 22. Flow controller 22 directs power to specific components of water saver segment 10B and energy saver segment 10A. In the static state the pressurized cool water supply line 12 furnishes the cool water supply through manual shut off valve 14, through main cool water supply conduit 16 to inlet 43 of flow control unit 10. The flow path continues via conduits 45, 90 and 92, to the inlet side of normally open-to-flow, remotely actuated valve 94.

The output side of valve 94 is in fluid communication with the input side of hot water supply 31, via check valve 96, conduit 99 and flow control unit outlet 98 and cool water inlet conduit 30, causing hot water supply 31 to be subject to system supply pressure. Cool water supply to the structure's cool water service conduits is via main cool water supply conduit 16, continuing through conduit 51. The flow is branched from conduit 51 at service conduit 7 to service Area A and at service conduit 8, to service Area B. Any additional cool water service areas would be branched from conduit 51.

The hot water output of hot water supply 31 supplies hot water, under system pressure to the structure. Hot water flow is via hot water supply conduit 32 and conduit 40. Each service line to separate use points in the structure is branched off from conduit 40. Hot water service conduit 42 branches off to furnish hot water to sink 3 through shut-off valve 44 and to shower/bath outlet 50, via conduit 46, and manual control valve 48. Hot water service conduit 52 branches from conduit 40 to furnish hot water to sink 4 via shut-off valve 54 and to shower/bath outlet 60 via conduit 56 and manual control valve 58. Opening any hot water outlet will permit the use of pressurized hot water.

Manual crossover valve 27, when in the open-to-flow condition, completes a flow path from hot water service conduit 42 thru hot water crossover conduit 28 to cool water service conduit 7 via cool water crossover conduit 26. A flow path continues via conduit 51, flow control unit inlet 43 and conduits 45 and 81, to the inlet of normally closed-to-flow, remotely actuated valve 82. The outlet side of valve 82 is in fluid communication with the inlet of pump 66. The outlet of pump 66 is in fluid communication with the junction of conduit 99, via check valve 68 and conduit 69. A flow path is competed to the cool water inlet of hot water supply 31 via flow control unit outlet 98 and cool water inlet conduit 30.

Radio control unit 11 is moisture proof radio signal remote, in radio communication with flow control unit 10.

Remote control unit 9 is in electrical continuity with the flow control unit 10.

Manual shutoff valve 5 controls cool water to area A and manual shutoff valve 4 controls cool water to area B.

Operation FIG. 2

Conserving Water: Assuming hot water is desired at service area A, a manual crossover control valve 27 is turned to the open position completing a crossover flow path from hot water service crossover conduit 28 at hot water service manual shut off valve 44 to cool water service crossover conduit 26 at cool water service shut off valve 5. A conduit path is now available from hot water service conduit 42 to cool water service conduit 7, completing a conduit path from hot water supply 31 to service area A at sink 3, and returning back to hot water supply 31. To activate the system remote control unit 9 is operated to send a command to the system. Power control unit 21 furnishes the power to flow controller 22, and the following timed sequence occurs, within water saver segment 10B:

Pump 66 is activated and normally closed-to-flow remotely activated valve 82 is energized to the open-to-flow position and a flow path is established. Using hot water service conduit 42 as a starting point along a closed loop flow path, water in hot water service conduit 42, in fluid communication with conduit 7 through manual crossover control valve 27, now permits the pumping action of pump 66 to create pressure, causing flow via conduits 7 and 52 to inlet 43 of flow control unit 10. Flow continues through conduits 45 and 81 to the inlet of normally closed-to-flow, remotely actuated valve 82, now energized to the open-to-flow condition. The outlet of valve 82 is coupled to the inlet of pump 66 via conduit 65. The output of pump 66 is via conduit 67 and flow is completed through check valve 68, and conduit 69 to flow control unit outlet 98. The pumping action of pump 66, operating within a closed loop causes the circulation of hot water from the hot water outlet conduit 32 of hot water supply 31 and the path is completed via conduit 40, to starting point, hot water service conduit 42.

At a pre-programmed time, flow controller 22, causes remotely actuated valve 82 to be de-energized to the normally closed-to-flow position, interrupting the circulation loop. Pump 66 is de-energized and manual crossover control valve 27 is turned to the closed position. Hot water is available at the selected use point and no water has been wasted down the drain, waiting for hot water.

Normal Use Cycle

All the remotely actuated valves are de-energized and hot water supply pressure is now available for immediate use, as previously explained under the static state. The adjustable use cycle duration is programmed into the flow controller 22.

When control of the use cycle duration by the user, in the shower for example, is desired, then radio control unit 11 may be employed. Whether preprogrammed or controlled by the user, the operational function of the flow control unit 10 is the same. The preprogrammed signal or a signal from radio control unit 11, in the latter stage of the use cycle, causes the following events to occur, within energy saver segment 10A:

Energy Conservation Cycle

Flow controller 22 starts the sequence and energy saver 10A valves are configured as follows: Normally open-to-flow, remotely actuated valve 94 is energized to the close-to-flow position and normally closed-to-flow, remotely actuated valve 93 is energized to the open-to-flow position. Cool water supply pressure is interrupted to the hot water supply 31. Cool water supply pressure is now in fluid communication with conduit 97 and hot water supply conduit 32. Pressurized cool water flow is through conduit 91 and now open-to-flow remotely actuated valve 93, through check valve 95 and outlet 19 of flow control unit 10. Pressurized cool water acts to force hot water in conduits 40 and 42, to flow towards the open hot water outlet at sink 3 or shower/bath outlet 50. Depending upon the distance to the use point, the hot water user has a specified time to complete the use cycle. As the user senses the water cooling, the outlet is ready to be closed, as the user decides. Shortly thereafter the energy saver 10A valves are automatically de-energized once again to their static condition. Hot water normally left standing in the lines to cool, now has been fully utilized and replaced by cool water, so that energy is not wasted. An adjustable audible reminder device may be employed to signal the user that the water will turn cool in a specific period of time.

Service area B functions identical to service area A, except the hot water service conduit is conduit 52, and the cool water service conduit is conduit 8. Manual crossover control valve 72 is used to complete the crossover connection from hot water crossover conduit 73 to cool water crossover conduit 71 at sink 4. The adjustable time setting of the cycle is determined by the distance to service area B.

Check valves 95, 98 and 68 are to limit back flow, protecting system components. Remote control unit 9 is hard wired at one or more locations in the structure. Radio control unit 11 can be one of several moisture proof, battery operated, radio signal transmitting units, capable of communicating with a radio receiving device.

RAMIFICATIONS

Thus the reader will see that the universal water & energy conservation system provides a highly flexible water and energy conservation apparatus, adaptable to a user's economic capabilities, the availability and location of space within a structure and the construction status of the structure itself.

While my above description contains many specificities, these should not be construed as limitations on the scope of the invention, but rather as an exemplification of applicable embodiments thereof. Many other variations are possible. For example:

One ramification of the system is that it can be segmented as a combination system, wherein the energy saver segment is located near the hot water supply and a water saver segment is located at one or more hot water use areas. The water saver segment could be configured as a one mode or three mode device, where the operation of a toilet flush tank, a holding tank and a pump are combined. When hot water is desired and the use of the toilet flush tanks is also required, actuating the water saver segment in mode 1 permits the cool water in the hot water line, under pressurized hot water supply, to be directed to refill the toilet flush tank, which has been emptied; thus bringing hot water to the use area without wasting water down the drain.

Operating the water saver segment in mode 2, when hot water is desired, would cause cool water in the hot water conduits, under pressurized hot water supply, to be directed to a holding tank, making hot water available without wasting water down the drain.

Operating the water saver segment in mode 3, would cause stored water to be pumped to refill an emptied flush tank, when it has been emptied but there is no current demand for hot water making use of previously saved water.

Another ramification is that the described holding tank could be coupled through associated conduits, to a clothes washer, a drip irrigation system or some other water use apparatus.

Another ramification is that where a water saver segment is installed at a hot water use area, a small use point water heater could be added with a minor alteration to the hot water service conduit, which would then eliminate the need for the holding tank and the pump. The water saver segment would then operate in a short cycle hot water use mode, and a long cycle hot water use mode. Water savings would be realized and couplings to other water use apparatus would be eliminated.

Another ramification of the system is that it can be configured as an integrated unit with all operating components located in close proximity to the hot water supply. A holding tank would be included which would receive the standing cool water in the hot water lines, each time hot water is demanded at a hot water use area. The holding tank could be located anywhere in the structure, and it would be capable of having its saved water pumped to other water apparatus in the structure, or a drip irrigation system, through associated conduits.

Another ramification of the system is that, where pressure levels permit, a pressure reducer could be substituted for the normally open-to-flow remotely actuated valve of the energy saver segment.

Another ramification of the system is that, where pressure levels permit, a spring loaded check valve could be substituted for the normally open-to-flow remotely actuated valve of the energy saver segment.

Another ramification of the system is that, where building practices would permit, a remotely actuated valve could be installed in the main cool water supply to temporarily interrupt supply pressure to the cool water conduit system. This would permit hot water, under supply pressure, to force cool water out of the hot water supply and service conduits, through a manual cross over valve, to a holding tank, a flush tank or other water apparatus.

Another ramification of the system is that one or more remotely actuated valves and the associated conduits could be added to the flow control unit to service additional hot water use areas.

Another ramification is that, in a building where extensive alterations to a standard plumbing plan would be acceptable and/or where electric service is inadequate, the electromechanically controlled energy saver segment, could be replaced by manual diverter valves located at each hot water use area; most efficiently in close proximity to each shower/bath outlet valve.

Another ramification of the system is it may be adapted and expanded for installation at multi use facilities such as motels, hotels, military quarters, college dormitories, etc.

Another ramification of the system is it may be configured as a must activate system, which will not deliver hot water until the system is activated. A room key, magnetic coded strip card or other secure device could be employed to limit access.

Another ramification of the system is that thermal sensors could be incorporated to control the operation of a pump and selected system components.

Another ramification is that flow sensitive devices may be installed to control the operation of a pump and selected system components.

Another ramification of the system is that one or more said manual crossover valves may be replaced by one or more remotely actuated valves, energized and de-energized by remote control signals from a radio control means or from a remote control means in electrical continuity with the system.

The present disclosure includes that contained in the appended claims as well as that of the foregoing description. It is understood that the present disclosure of the preferred forms has been made only by way of example. Although preferred and alternate embodiments of the present invention have been disclosed above, it will be appreciated that numerous alterations and modifications thereof will no doubt become apparent to those skilled in the art, after having read the above disclosures. It is therefore intended that the following claims be interpreted as covering all such alterations and modifications as fall within the true spirit and scope of the invention.

I claim:

1. A plumbing system having a pressurized cool water supply, a plurality of cool water outlets and a plurality of hot water outlets, having a cool water supply conduit for the purpose of coupling said cool water supply to a cool water inlet of a hot water supply means and a second cool water supply conduit in fluid communication with a plurality of branched cool water service conduits to each cool water outlet, and having a hot water supply conduit for the purpose of coupling a hot water outlet of said hot water supply means to a plurality of hot water service conduits, each branched to a hot water outlet, a water and energy conservation system, remotely controlled, for supplying hot water on command, without permitting water to be wasted down the drain, and for, automatically by programmed timed command or optionally by a user's remote command, utilizing all of the hot water delivered to any hot water outlet from said hot water supply means, configured so as to be capable of segmentation, at the discretion of the user, for independent operation as a water saver segment only or as an energy saver segment only, comprising in combination:

(a) a power source;

(b) a power distribution means for distributing power to selected components activated by remote command;

(c) a remote control means in electrical continuity with said water and energy conservation system;

(d) a radio control means in radio communication with said water and energy conservation system;

(e) a radio receiving means in radio communication with said radio signal remote control means;

(f) a power control means to direct the application of power;

(g) a pump;

(h) a plurality of separate return conduits, each in separate fluid communication with a separate said hot water service conduit and each in fluid communication with separate inlets of a water saver segment;

(i) a flow control unit comprising: said water saver segment including a plurality of separate, remotely actuated valves, normally closed to flow, the inlet side of each separate valve in fluid communication with each separate hot water use point through each said separate return conduit and the outlets of the valves joined in fluid communication with the inlet of said pump, the outlet of said pump in fluid communication with said cool water supply conduit to said hot water supply and (j) an energy saver segment including a first remotely actuated valve means normally open-to-flow, the inlet of the valve in fluid communication with the cool water supply conduit and the outlet of the valve in fluid communication with said cool water inlet of said hot water supply means and a second remotely actuated valve means, normally closed-to-flow, the inlet of the valve in fluid communication with the cool water supply conduit and the outlet of the valve in fluid communication with the hot water supply conduit;

(k) a first check valve to limit back flow through the first valve means;

(l) a second check valve to limit back flow through the second valve means;

(m) a programmable controller means in electrical continuity with said water saver segment, said energy saver segment and said power source.

2. A water and energy conservation system according to claim 1, wherein a plurality of visual and/or audio signaling means are included for the purpose of alerting the system user to the operating condition of said water and energy conservation system.

3. A water and energy conservation system according to claim 1 wherein an over-ride command capability is included for the purpose of lengthening or shortening a programmed hot water use cycle.

4. A system according to claim 1, wherein the flow control unit is initially configured for independent operation as an energy saver segment, to which a water saver segment may later be conveniently attached, thus making up a complete water and energy conservation system.

5. A system according to claim 1 wherein the flow control unit is initially configured for independent operation as a water saver segment, to which an energy saver segment may later be conveniently attached, thus making up a complete water and energy conservation system.

6. A water and energy conservation system according to claim 1 wherein the system is configured in a manner that makes an activate signal mandatory, before the system will permit hot water to be delivered to any outlet.

7. A system according to claim 1 in an expanded configuration for installation in a multi unit complex such as motels, hotels, military quarters, college dormitories, or other multiple use point structures.

8. A plumbing system having a pressurized cool water supply, a plurality of cool water outlets and a plurality of hot water outlets, having a cool water supply conduit for the purpose of coupling the cool water supply to a cool water inlet of a hot water supply means and a second cool water supply conduit in fluid communication with a plurality of branched cool water service conduits to each cool water outlet, and having a hot water supply conduit for the purpose of coupling a hot water outlet of said hot water supply means to a plurality of hot water service conduits branched to each hot water outlet, a water and energy conservation system remotely controlled for supplying hot water on command, without permitting water to be wasted down the drain, and for automatically by programmed timed command or optionally by a user's remote command, utilizing all of the hot water delivered to a hot water use area from said hot water supply means, configured so as to be capable of segmentation, at the discretion of the user, for independent operation as a water saver segment only, or as an energy saver segment only, comprising in combination:

(a) a power source;

(b) a power distribution means for distributing power, to selected components activated by remote command;

(c) remote control means in electrical continuity with said water and energy conservation system;

(d) a radio signal remote control means;

(e) a radio receiving means in radio communication with said radio signal remote control means, for the purpose of receiving radio commands;

(f) a power control means, to direct the application of power;

(g) a pump;

(h) a plurality of manual crossover control valves, each in separate fluid communication with the hot water service conduit and the cool water service conduit of its specific water use area;

(i) a flow control unit comprising a water saver segment including a normally-closed-to-flow, remotely actuated valve and said pump, the inlet side of the valve in fluid communication with the cool water supply and the outlet of the valve in fluid communication with the inlet of said pump, the outlet of said pump in fluid communication with said cool water cool water supply conduit to said hot water supply and (j) an energy saver segment including a first remotely actuated valve means normally open-to-flow, the inlet of the valve in fluid communication with the cool water supply conduit and the outlet of the valve in fluid communication with said cool water inlet of said hot water supply means and a second remotely actuated valve means, normally closed-to-flow, the inlet of the valve in fluid communication with the cool water supply conduit and the outlet of the valve in fluid communication with the hot water supply conduit;

(k) a first check valve to limit back flow through the first valve;

(l) a second check valve to limit back flow through the second valve;

(m) a programmable controller means in electrical continuity with said water saver segment, said energy saver segment and said power source.

9. A water and energy conservation system according to claim 8, wherein a plurality of visual and/or audio signaling means are included for the purpose of alerting the system user to the operating condition of said water and energy conservation system.

10. A water and energy conservation system according to claim 8 wherein an over-ride command capability may be included for the purpose of lengthening or shortening a programmed hot water use cycle.

11. A system according to claim 8, wherein the flow control unit is initially configured for independent operation as an energy saver segment, to which a water saver segment may later be conveniently attached, thus making up a complete water and energy conservation system.

12. A system according to claim 8, wherein the flow control unit is initially configured for independent operation as a water saver segment, to which an energy saver segment may later be conveniently attached, thus making up a complete water and energy conservation system.

13. A water and energy conservation system according to claim 8, wherein the system may be configured in a manner that makes an activate signal mandatory, before the system will permit hot water to be delivered to any outlet.

14. A system according to claim 8 in an expanded configuration for installation in a multi unit complex such as motels, hotels, military quarters, college dormitories, or other multiple use point structures.

* * * * *